United States Patent [19]

Giulie

[11] 4,112,603

[45] Sep. 12, 1978

[54] LUGGAGE TAG

[75] Inventor: Joe D. Giulie, Palo Alto, Calif.

[73] Assignee: General Binding Corporation, Northbrook, Ill.

[21] Appl. No.: 776,823

[22] Filed: Mar. 14, 1977

[51] Int. Cl.[2] ..... A44C 3/00

[52] U.S. Cl. ..... 40/2 R; 40/21 R

[58] Field of Search ..... 40/2 R, 2 A, 21 R, 21 C, 40/20, 20 R, 10 C, 316

[56] References Cited

U.S. PATENT DOCUMENTS 1,337,722 4/1920 Porter ..... 40/21 R 3,228,129 1/1966 Gwinn et al. ..... 40/21 R

FOREIGN PATENT DOCUMENTS 1,223,679 4/1965 Fed. Rep. of Germany ..... 40/21 A

*Primary Examiner*—Louis G. Mancene
*Assistant Examiner*—Wenceslao J. Contreras

[57] ABSTRACT

An inexpensive heat sealable tag having a pressure sensitive attachment means formed as part thereof is provided. The tag can be used for a variety of purposes such as the identification of luggage and the like, an instruction sheet attached to an instrument and for many other purposes.

3 Claims, 7 Drawing Figures

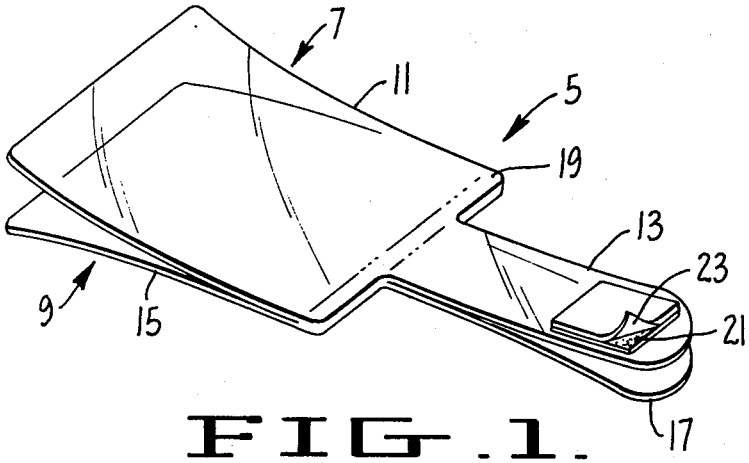
FIG. 1.
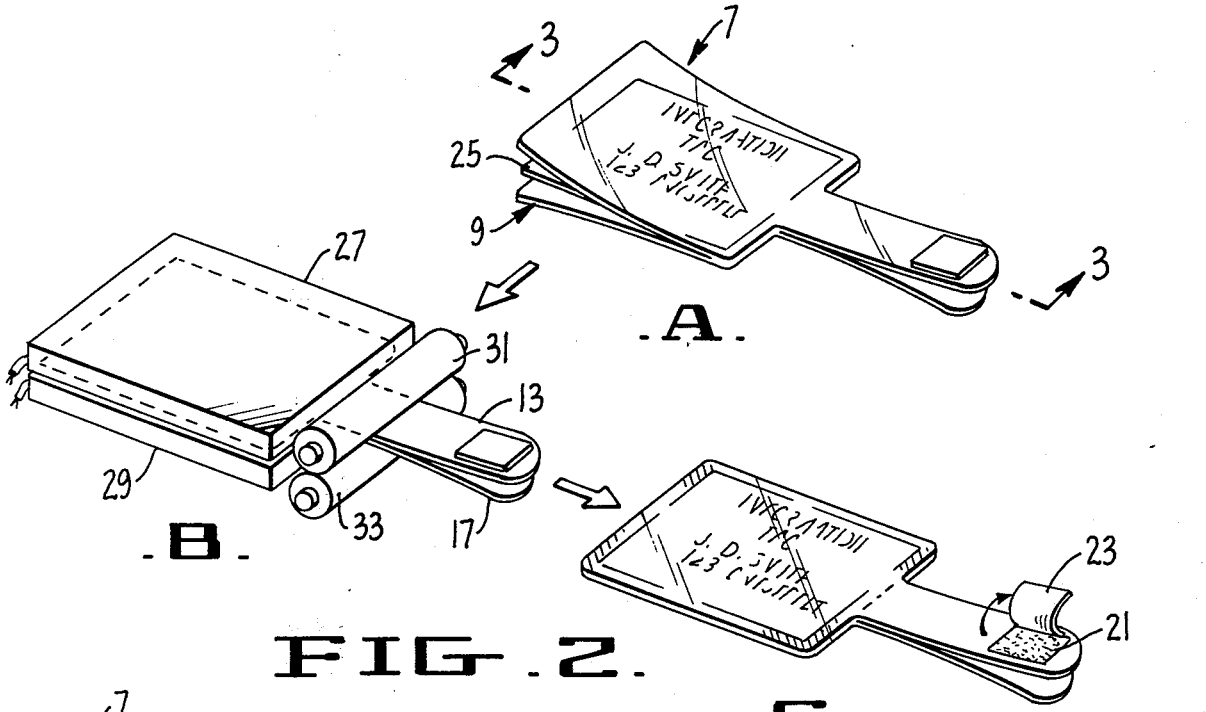
FIG. 2.
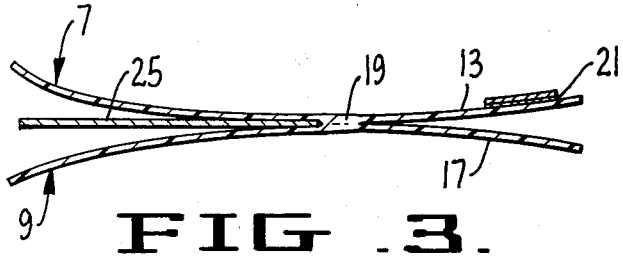
FIG. 3.
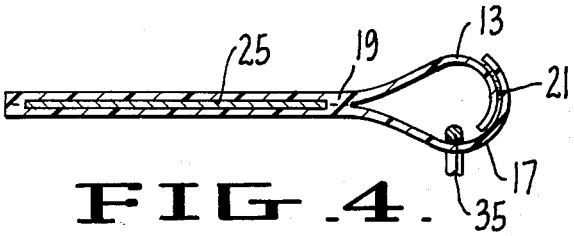
FIG. 4.
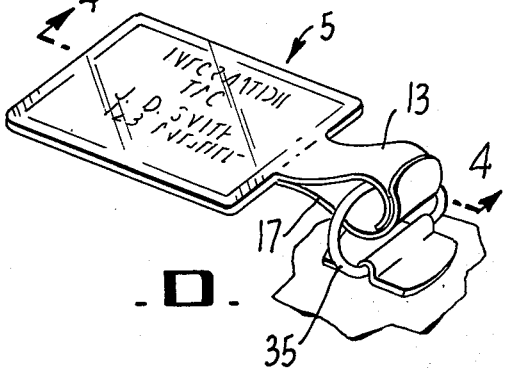

LUGGAGE TAG

BRIEF DESCRIPTION OF THE DRAWINGS

FIG. 1 is a perspective view of a tag embodying the present invention.

FIGS. 2 A, B, C and D show the steps employed in utilizing the tag of the present invention.

FIG. 3 is an enlarged section on the line 3—3 of FIG. 2A.

FIG. 4 is a section on the line 4—4 of FIG. 2D.

DESCRIPTION OF THE PREFERRED EMBODIMENTS

The tag of the present invention is generally designated 5 and includes an upper sheet generally designated 7 and a lower sheet generally designated 9. Sheet 7 preferably consists of Mylar with its underside coated with a heat activated adhesive or a thermoplastic material and is of a generally rectangular portion 11 having an elongated tongue 13 formed at one edge. Lower sheet 9 is similarly proportioned having a complementary rectangular portion 15 and a tongue 17 and is of material which will heat seal to the upper sheet. The upper and lower sheets are sealed together along line 19, i.e. along one edge of the rectangular portion, adjacent to the tongue. On the outer surface of one of the tongues is a small patch of a pressure sensitive material 21 with a protective layer 23 of wax paper or similar material.

In order to utilize the tag of the present invention, a card 25 or similar article to be laminated, is placed between the portions 11 and 15 of sheets 7 and 9 as shown at 2A. The rectangular portions of the sheets 7 and 9, namely those portions designated 11 and 15, are now placed between heated platens 27 and 29 and heated for a sufficient time to soften the heat activated adhesive or thermoplastic, as is shown at 2B. It will be noted that the tongues 13 and 17 are not heated and extend beyond the platens and between two rollers 31 and 33. When the plastic or adhesive has sufficiently softened, one grasps the tongues 13 and 17 and pulls the tags between the rollers 31 and 33 which completes the laminating operation. As shown in FIG. 2C, one now removes the protective covering 23 from the pressure sensitive material 21 and bends the tongues 13 and 17 around a handle 35 or the like. The pressure sensitive surface is brought into contact with the mating tongue as is shown in FIG. 2D and 4 to complete the taging operation.

Many variations can be made in the exact structure shown without departing from the spirit of this invention. For instance, the sealing portions of the tag have been described as being rectangular since this is the usual form for such tags but they can be square, round, oval or any desired shape. Similarly, the tongues have been shown as coming from the center of the narrow edge of the rectangular portions but this arrangement is not necessary and the tongues could extend from one edge, a corner or the like. The pressure sensitive adhesive could be on the inner surface rather than the outer surface of the tongue. The tongues need not be of the same length.

I claim:

1. A tag for luggage or the like comprising in combination:

a. a first sheet of a plastic material having an outer surface and inner surface and having an enlarged portion and a tongue extending therefrom;

b. a second sheet of substantially the same configuration;

c. said first and second sheets lying over each other with their inner surfaces together and being attached together adjacent the junction between the enlarged portion and the tongue, leaving most of the area of the enlarged portions free;

d. at least one of said first and second sheets having a heat-activated plastic coating on the inner surface of the enlarged portion thereof;

e. an area of pressure sensitive adhesive on the outer surface of said tongues, said pressure sensitive adhesive being protected by a layer of material which can be striped off of said pressure sensitive adhesive;

f. whereby one can place a card or the like between said first and second sheets and heat and press only the enlarged portions thereof leaving said tongues free and said protective layer removed from said pressure sensitive adhesive and the tongues adhered together.

2. The tag of claim 1 wherein each sheet is of rectangular configuration with a tongue extending from one of the short sides of the rectangle.

3. The tag of claim 1 wherein at least one of the sheets is mylar coated with a heat activated plastic.

* * * * *